US006192533B1

(12) United States Patent
Porcheron

(10) Patent No.: US 6,192,533 B1
(45) Date of Patent: Feb. 27, 2001

(54) ELEVATOR CHAIRS FOR THE HANDICAPPED AND INVALIDS

(75) Inventor: François Porcheron, Lyons (FR)

(73) Assignee: I.D.C. Medical, Beynost Cedex (FR)

( * ) Notice: Subject to any disclaimer, the term of this patent is extended or adjusted under 35 U.S.C. 154(b) by 0 days.

(21) Appl. No.: 09/283,997

(22) Filed: Apr. 2, 1999

(51) Int. Cl.[7] ..... A61G 5/14

(52) U.S. Cl. ..... 5/86.1; 5/81.1 R; 5/629; 280/304.1; 297/DIG. 10

(58) Field of Search ..... 5/81.1 R, 624, 5/86.1; 280/304.1; 297/DIG. 10

(56) References Cited

U.S. PATENT DOCUMENTS

| | | | | |
|---|---|---|---|---|
| 3,138,402 | * | 6/1964 | Heyl, Jr. et al. | 5/83.1 X |
| 4,076,304 | * | 2/1978 | Deucher | 297/DIG. 10 |
| 4,231,614 | * | 11/1980 | Shaffer | 297/DIG. 10 |
| 4,519,649 | * | 5/1985 | Tanaka et al. | 297/DIG. 10 |
| 4,569,556 | * | 2/1986 | Pilot | 297/DIG. 10 |
| 4,623,194 | * | 11/1986 | PILLOT | 297/DIG. 10 |
| 4,637,652 | * | 1/1987 | Bergenwall | 297/DIG. 10 |
| 5,108,202 | * | 4/1992 | Smith | 297/DIG. 10 |
| 5,556,121 | * | 9/1996 | Pillot | 297/DIG. 10 |
| 5,772,226 | | 6/1998 | Bobichon . | |

FOREIGN PATENT DOCUMENTS

| | | |
|---|---|---|
| 0146660 | 7/1985 | (EP) . |
| 0231718 | 8/1987 | (EP) . |
| 2529456 | 1/1984 | (FR) . |
| 2545718 | 11/1984 | (FR) . |
| 2553650 | 4/1985 | (FR) . |
| 1264969 | 2/1972 | (GB) . |
| 2120537 | 12/1983 | (GB) . |
| 8201314 | 4/1982 | (WO) . |

OTHER PUBLICATIONS

V. P. Agrawal, et al., "Optimisation of a chair mechanism for partially disabled people for sitting–standing and sitting–lying motions", Medical & Biolical Engineering & Computing, vol. 17, No. 5, Sep. 1979, pp. 671–682.

* cited by examiner

*Primary Examiner*—Michael F. Trettel
(74) *Attorney, Agent, or Firm*—Dennison, Scheiner, Schultz & Wakeman

(57) ABSTRACT

A chair for the handicapped or invalids. In the chair the second assembly is disposed at least in part behind the front plane and is linked to the first assembly by at least one reversible actuation and coupling rod, itself set back from the front plane and beneath the plane defined by the seat in its low position. The invention is particularly applicable to verticalizing chairs.

7 Claims, 3 Drawing Sheets

ELEVATOR CHAIRS FOR THE HANDICAPPED AND INVALIDS

The present invention relates to chairs, generally but not exclusively wheel-chairs, for use by the handicapped and by invalids, and it is equally applicable to folding wheel-chairs and to non-folding wheel-chairs.

BACKGROUND OF THE INVENTION

There is no doubt that wheel-chairs have given mobility to the handicapped and to invalids. Nevertheless, such wheel-chairs suffer from various drawbacks due to the fact that their users can occupy a sitting position only, which position is also generally maintained for relatively long periods of time.

Such a position is unsuitable for providing readaptation to ordinary life and it does not facilitate social contacts. In addition, when a sitting position is maintained for relatively long periods of time, it causes physical deterioration, such as the loss of angular amplitude in the lower limbs, defective blood circulation, slowing down of the digestive and intestinal functions, bone fragility, etc.

To remedy the above drawbacks, proposals have been made for chairs each having a chassis that supports a hinged structure comprising a seat back, a seat, and a footrest. Such a structure is mounted in hinged relationship to the seat on a front horizontal axis, extending perpendicularly to the vertical plane of symmetry of the chassis. The hinged structure can be controlled with full motorization or with motorization for power assistance to cause the seat to pass from a low position to a high position, and vice versa. Such chairs are often referred to as "verticalizing chairs".

Regardless of whether the source of power that controls raising and lowering of the hinged structure or that enables it to be controlled is based on electricity, or on elastic actuators, in particular gas actuators, or is purely manual, chairs of the above type have certainly made it possible to a large extent to solve the drawbacks that stem from using a conventional chair.

That is doubtless why such chairs have been such a success over several years. By way of reference, mention can be made of French patent FR 2 529 456 which specifically relates to a design for such a verticalizing chair.

Although they give satisfaction, it appears that such chairs give rise to objections concerning comfort relating in particular to the nature of the hinged structure for raising and lowering the invalid or handicapped person in a position of maximum safety.

Account needs to be taken of the hinged nature of the structure which is capable of passing from a traditional seated position to an elevated or verticalizing position in which the various segments making up the structure are substantially in alignment one after another, in a pseudo-vertical direction.

To satisfy anatomic requirements in the various positions that can be occupied, the hinged structure is made up of a seat element, a back element, and a footrest element which must therefore be capable of taking up one relative position that is generally of the seated type and another relative position in which they are placed in line with one another in the verticalizing position.

Although they give satisfaction, such elevating chairs give rise to a drawback in use that stems directly from their structure.

As a general rule, the footrest assembly is situated in front of the front plane of the chassis by an amount which naturally varies in use, depending on whether the hinged structure is in its low position or in its verticalization position.

Such a disposition gives rise to problems of use, given that the overall front-to-back dimensions can vary to a considerable extent between these two positions.

In addition, it appears that the assembly constituting the footrest is made up of one or more projecting vertical portions corresponding to uprights or leg portions for supporting one or more footrest-constituting flaps.

This forward projection of the uprights constitutes an obstacle that impedes transferring the handicapped user of a verticalizing chair to some other person-receiving structure, or vice versa.

Furthermore, when the load-carrying structure of the footrest is formed by an upright disposed more particularly in the sagittal plane of symmetry of the chair, the rigid assembly constituting it is necessarily placed between the inert legs of the subject and then, specifically because of the lack of feeling that the lower limbs generally present, it represents an obstacle or a presence that is responsible for the risk of bruising to a greater or lesser extent that ought to be avoided.

OBJECTS AND SUMMARY OF THE INVENTION

The object of the invention is to propose improvements to an elevating chair for the handicapped and invalids, and more particularly improvements to the structure of the footrest so as to overcome the above drawbacks.

The proposed improvements seek to reduce the space occupied in front, to reduce obstacles to transfer, and to be suitable for fitting to footrest structures regardless of whether they include a central supporting upright or else two side uprights, as is generally the case in present elevating chair structures.

The improvements of the invention also seek to provide relatively simple adaptation of present chair structures, without requiring fundamental structural modifications that would require a new overall structure of the chassis or of the hinged structure carried by such a chair to be reconsidered, redesigned, and rebuilt.

To achieve the above objects, the invention provides an elevator chair for the handicapped and invalids, the chair comprising a chassis supporting a hinged structure made up of a seat, a footrest, and a back, such a structure comprising:

- a first assembly in the form of a deformable quadrilateral contributing to supporting the seat, made up of top and bottom bars hinged to the front portion of the chassis substantially in a front plane and linked towards their rear portions by spacer pieces;
- a second assembly in the form of a deformable quadrilateral contributing to supporting the footrest and linking the chassis to the first assembly;
- a back frame hinged to the first assembly, at its end opposite from the second assembly; and
- a drive assembly interposed between the deformable first assembly and the chassis and performing a pivot-controlling function so as to cause the hinged structure to pass from a low position to an elevated position in which the seat, the footrest, and the back are substantially in alignment on a pseudo-vertical direction, and vice versa.

In such a chair the second assembly is disposed at least in part behind the front plane and is linked to the first assembly by at least one reversible actuation and coupling rod, itself set back from the front plane and beneath the plane defined by the seat in its low position.

BRIEF DESCRIPTION OF THE DRAWINGS

Other characteristics appear from the following description given with reference to the accompanying drawings which show embodiments of the invention as non-limiting examples.

MORE DETAILED DESCRIPTION

Figure 1:
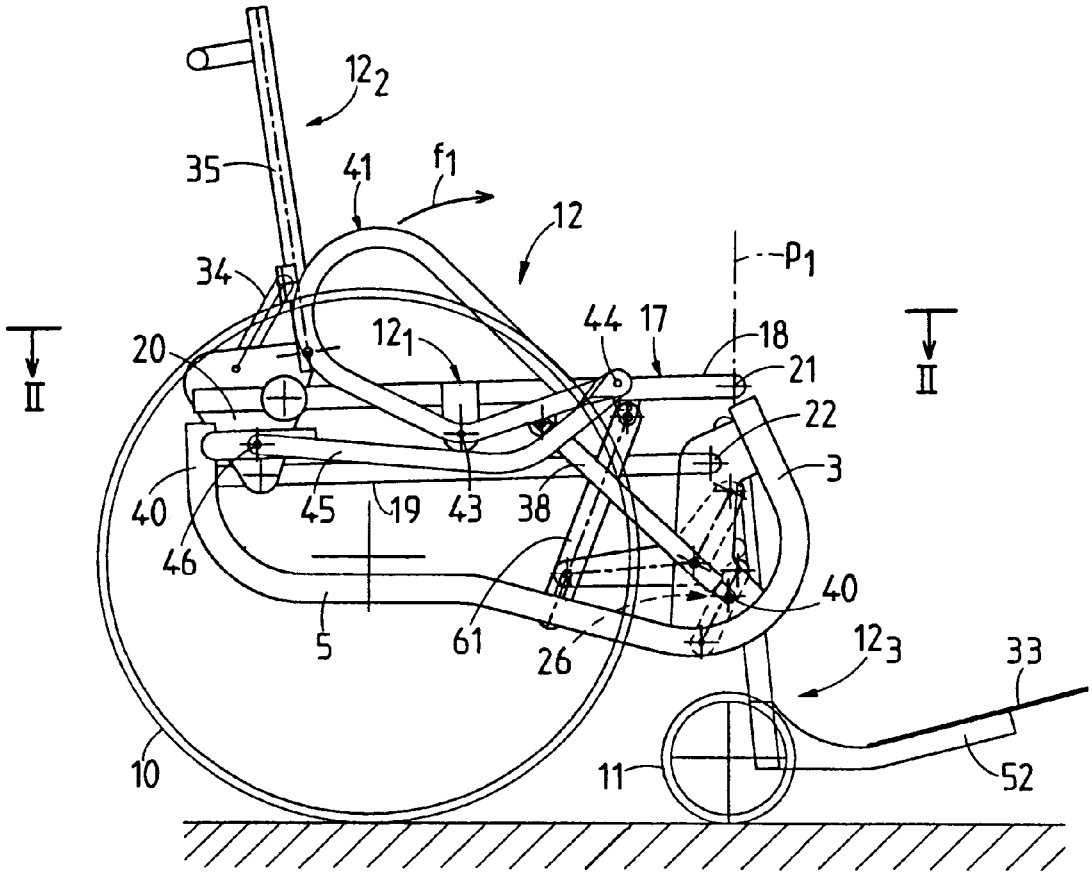
FIG. 1 is a side elevation of an elevator chair of the invention.
Figure 2:
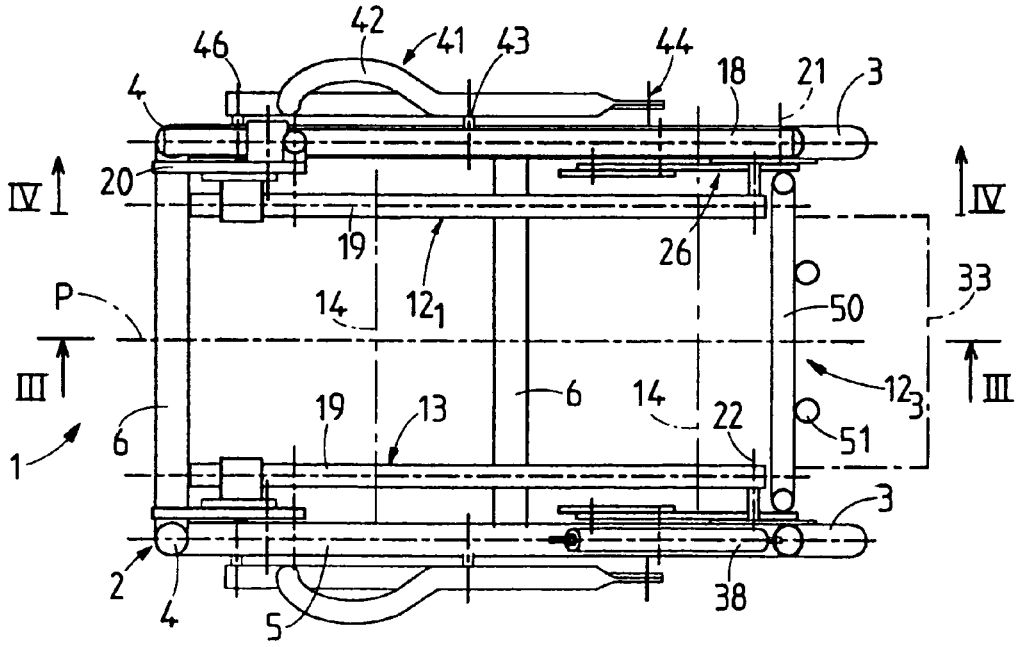
FIG. 2 is a plan view on line II—II of FIG. 1.

FIGS. 1 and 2 are diagrams showing a wheel-chair 1 comprising a chassis 2 having front uprights 3 and back uprights 4 united by length members 5 and cross-members 6. In conventional manner, the chassis 2 is provided with load-carrying and driving wheels 10 and with steerable swivel wheels 11.

The above chassis 2 corresponds to a chair of rigid design but it is clear that a substantially analogous structure could be used for a folding chair. Under such circumstances, the rigid elements forming the cross-members 6 need to be replaced by folding elements of conventional design.

In accordance with the invention, the chassis 2 is fitted with an elevator device 12 implemented in the form of a hinged structure defining a seat frame 121, a back frame 122, and a footrest frame 123. The hinged structure preferably has two hinge systems 13 that are symmetrical about a plane of symmetry or "sagittal" plane such as P of the chair or load-carrying chassis 2. Each hinged system 13 is designed to be fitted on the side of the chassis 2 and is united with the corresponding system 13 by transverse elements 14 represented by chain-dotted lines in FIG. 2. Such elements 14 may be rigid or hinged.

Each hinged system 13 comprises, for the seat frame $\mathbf{12}_1$, a deformable first assembly 17 made in the form of a quadrilateral constituted by two bars 18 and 19 which are hinged level with a front plane $p_1$ corresponding to the chassis by hinged points 21 and 22. The bars 18 and 19 of each lateral assembly 17 are united via their terminal portions remote from the plane $p_1$ by a spacer strip 20 whereby the assembly is linked to the back frame $\mathbf{12}_2$, and more particularly to the upright 35 thereof. The link between each of the assemblies 17 and the back frame 122 is preferably provided via a triangulating strut 34.

Each hinged system 13 comprises, for the footrest frame $\mathbf{12}_3$, an assembly 26 that is deformable and that is interposed between the chassis 2 and the first assembly 17.

Each deformable structure 17, implemented in this case in the form of a deformable parallelogram, is associated with a resilient member 38, e.g. interposed between the top bar 18 and the chassis 2, being fitted to said elements via hinge points 39 and 40, which are optionally adjustable in position. The resilient member 38 is designed to take on the functions of compensating weight and absorbing energy, and also a function of restoring energy which can be constituted by a compensating spring or by a gastight actuator.

FIG. 2 shows that it is advantageous to place each resilient member 38 in the vertical plane passing through the uprights 3 and 4 situated on either side of the sagittal plane P.

Each hinged system 13 is also associated with a drive assembly 41 that is to take on a function enabling pivoting the hinged system 13 relative to the chassis to be under manual control, and a locking function both in the fully lowered position as shown in FIG. 1 and in an elevated position as explained below.

The drive assembly 41 for each hinged system comprises a lever 42 hinged at a point 43 on the first quadrilateral 17 and preferably on its top bar 18. The lever 42 is linked via a hinge point 44 to a rod 45 mounted via a hinge 46 on the chassis 2.

The above-described structure is designed to enable a low position as shown in FIG. 1 to be established in which the seat frame $\mathbf{12}_1$ extends substantially horizontally being supported by the chassis 2, while the back frame $\mathbf{12}_2$ is raised substantially vertically, or preferably leaning backwards, and while the footrest frame $\mathbf{12}_3$ extends substantially vertically close to the front plane $p_1$ so as to support a footrest plate 33 in front of said plane.

Figure 5:
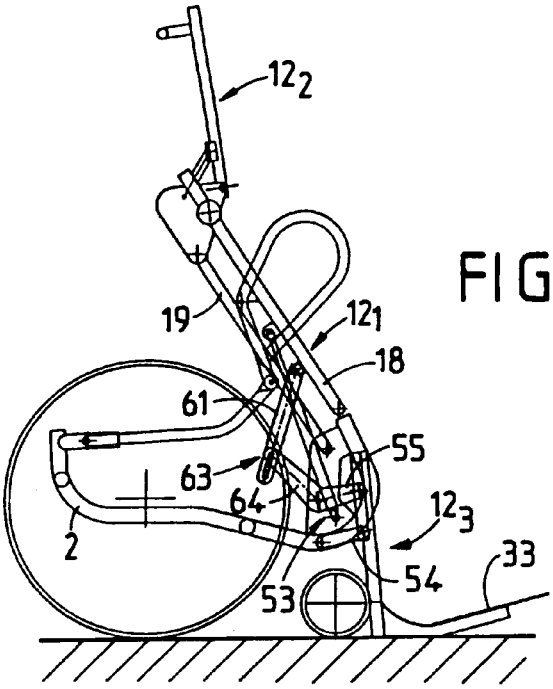
FIGS. 5 and 6 are elevation views analogous to FIG. 1, but on a different scale, showing two characteristic operating positions of the chair of the invention.

By acting in the direction of arrow $f_1$ on the assemblies 41, the hinged structure 12 can be moved into its verticalization position as shown in FIG. 5 so that the three frames $\mathbf{12}_1$, $\mathbf{12}_2$, and $\mathbf{12}_3$ take up a pseudo-vertical orientation in which they are substantially in line for supporting the body of a handicapped subject in a verticalizing posture by conventional body holding means.

The invention relates to improvements provided to an elevator chair of the above type, and said improvements seek mainly to adapt the footrest frame $\mathbf{12}_3$ by means of a deformable assembly 26.

FIGS. 1 to 4 show a first embodiment of improvements of the invention. In this example, the footrest frame $\mathbf{12}_3$ is constituted by a rectangular frame 50 located substantially in the front plane $p_1$ and linked to the two assemblies 17 constituting the seat frame $\mathbf{12}_1$ via two deformable assemblies 26 having the characteristic of being disposed at least in part behind the front plane $p_1$.

Figure 3:
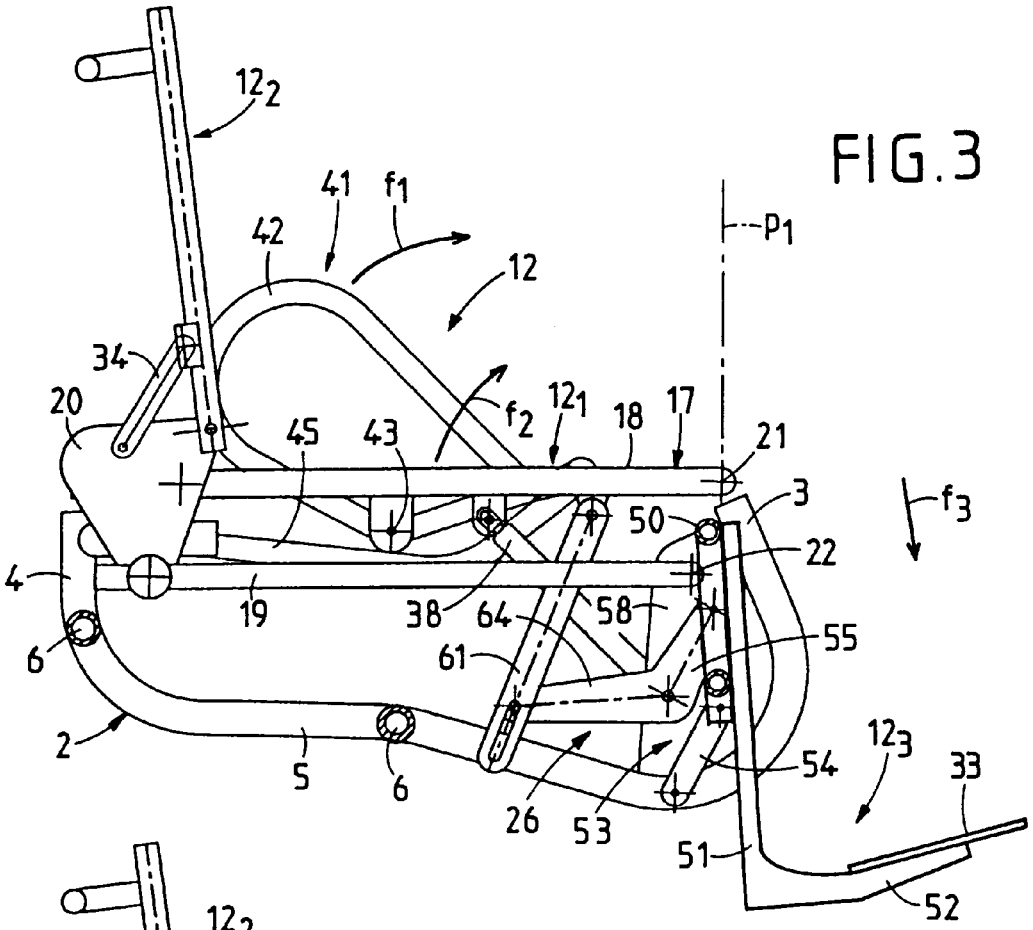
FIGS. 3 and 4 are cross-sections on lines III—III and IV—IV of FIG. 2.
Figure 4:
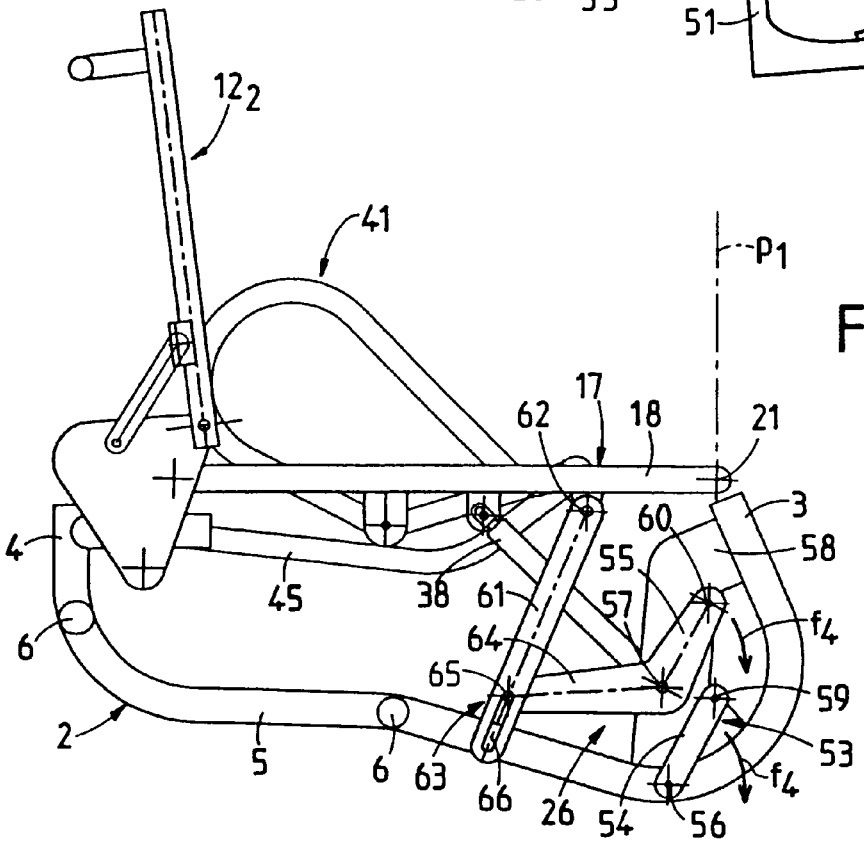

As can be seen in FIGS. 3 and 4, each deformable assembly 26 comprises a deformable parallelogram 53 constituted by two bars 54 and 55 which are hinged about axes 56 and 57 to the chassis 2. In one embodiment, hinge point 56 is carried by the corresponding longitudinal member 5 while hinge point 57 is carried by a side plate 58 uniting the front upright 3 to the longitudinal member 5. The hinge points 56 and 57 are disposed behind the front plane $p_1$.

The bars 54 and 55 extend from the hinge points 56 and 57 towards the front of the chassis 2 to be linked to the front rectangular frame 50 via hinge points 59 and 60.

The structural dispositions used are preferably selected so as to give the assembly 53 the character of a deformable parallelogram without that necessarily excluding the possibility of making it in the form of a deformable quadrilateral.

Each assembly 53 is linked to the corresponding assembly 17 of the seat frame $\mathbf{12}_1$ by a rod 61 providing reversible coupling and actuation which is hinged by a point 62 preferably to the top bar 18 and by a hinge 63 to one of the bars in the assembly 53, for example the bar 55.

The rod 61 is also disposed behind the front plate $p_1$ and beneath the plane defined by the seat frame in the low position, and to this end the bar 55 to which it is linked is implemented as a crank lever having one of its limbs constituting the bar 55 and having another limb 64 projecting away from the front plane $p_1$ to be linked to the rod 61 via the hinge 63.

In a preferred disposition, the hinge 63 is formed by a pin or the like 65 carried by one of the pieces and engaged to slide snugly in an oblong slot 66 in the other piece. From FIG. 4, it can be understood that the pin 65 is carried by the limb 64 while the oblong slot 66 is defined by the bottom terminal portion of the rod 61.

As can be seen from FIG. 1 and by comparing FIGS. 3 and 4, the means implemented by the improvements of the invention make it possible, behind the front plane $p_1$, to provide the two assemblies 26 and the control rods 61 which are all included within the chassis 2. Thus, the footrest frame $\mathbf{12}_3$ has no pieces that project from the plane containing the uprights 51, so there is no obstacle opposing lateral transfer of the legs of the handicapped user of the elevator chair as described above to some other person-receiving structure, or vice versa. Similarly, such a structural disposition eliminates the presence of any component that might otherwise occupy the sagittal plane P and form a presence that could give rise to bruising or the like by contact, vibration, or rubbing.

The above-described improvements do not alter the way in which combined relative displacement of the three frames $\mathbf{12}_1$, $\mathbf{12}_2$, and $\mathbf{12}_3$ takes place, which remains as described above. Starting from the position shown in FIG. 3, action in the direction of arrow $f_1$as described above taken on the drive assemblies 41 subjects the seat frame $\mathbf{12}_1$ to displacement in the elevation direction along arrow $f_2$, thereby raising the back frame $\mathbf{12}_2$ correspondingly via the strut 34 and simultaneously lowering the footrest frame $\mathbf{12}_3$ in the direction of arrow $f_3$. Even in the presence of slots 66, by means of the weight of the legs of the handicapped person, the upward displacement of the rods 61 enables the parallelograms 53 to function with their bars 54 and 55 pivoting in the direction of arrows $f_4$ and thus entraining the front rectangular frame 50 downwards.

This situation develops until the moment when the footrest frame $\mathbf{12}_3$ comes into contact with the ground as shown in FIG. 5 in a position which can be the fully verticalized position of the hinged structure 12, or preferably, a position corresponding to a state of partial verticalization, as shown in FIG. 5.

Figure 6:
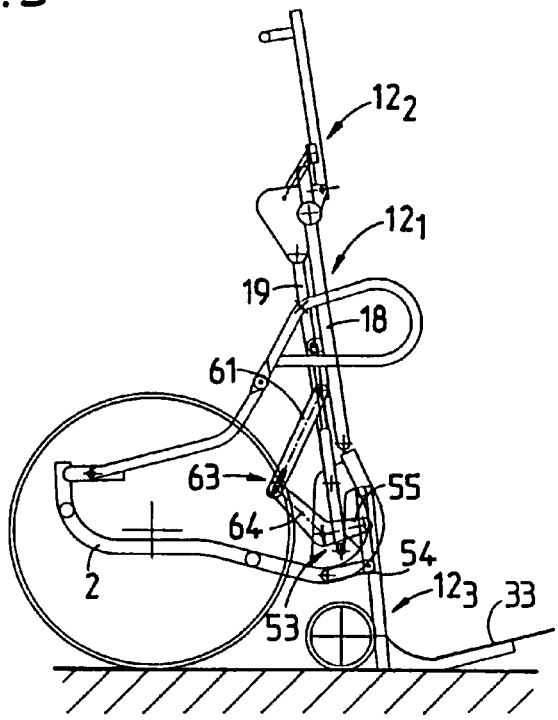

Under such circumstances, thrust from the footrest frame $\mathbf{12}_3$ corresponds to defining a support polygon for the chair in the verticalization position which can be reached, as shown in FIG. 6, by subsequent development solely of the seat frame $\mathbf{12}_1$ taking with it the back frame $\mathbf{12}_2$, given the compensation that takes place by means of the relative displacement authorized to the hinges 63 by the presence of the oblong slots 66 which are caused to move relative to the pins 65. It should be observed that the presence of the slots 66 serves, as soon as the footrest frame $\mathbf{12}_3$ touches the ground, to decouple the footrest frame from the seat frame, so to speak, thereby making it possible to benefit from upward action of the compensation members 38.

Operation opposite to that described above takes place when returning from the verticalization position to the low position shown in FIG. 1.

Figure 7:
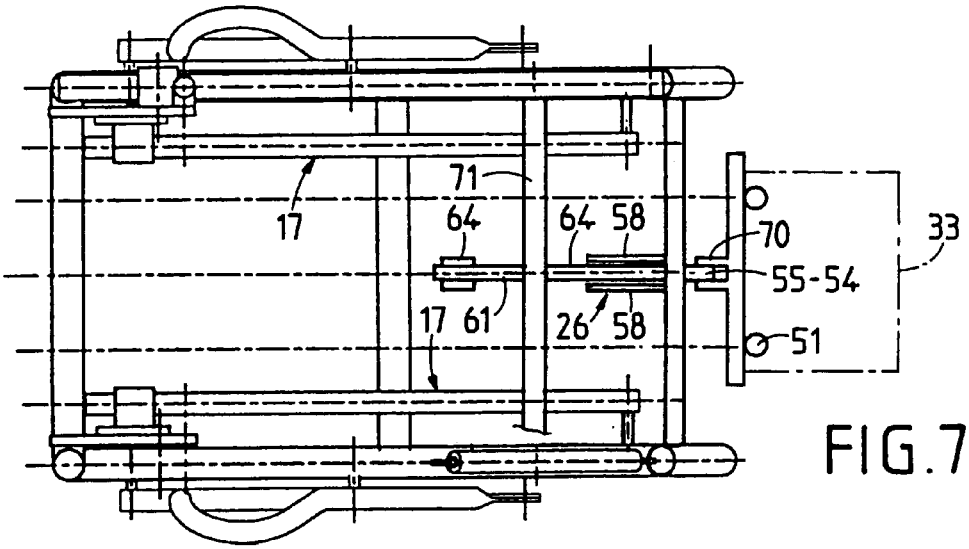
FIG. 7 is a diagrammatic plan showing a variant embodiment of the invention.

FIG. 7 shows a variant embodiment in which the front rectangular frame 50 is replaced by a front piece 70 that carries directly or indirectly the uprights 51 or the plate(s) constituting the footrest 33. In such a case, the front piece 70 is carried by a single deformable assembly 26 comprising a single quadrilateral or parallelogram 53 suitable for being fitted as described above on one or more plates 58 substantially occupying the sagittal plane P. The limb 64 is hinged as before by a hinge 63 to a single rod 61 which, for example, is hinged to a cross-member 71 secured to both assemblies 17 in the form of deformable quadrilaterals constituting the seat frame $\mathbf{12}_1$.

The invention is not limited to the examples described and shown since various modifications can be made thereto without going beyond its ambit.

What is claimed is:

1. An elevator chair for the handicapped and invalids, comprising a chassis supporting a hinged structure including a seat, a footrest, and a back, said seat being disposed substantially to a first side of a vertical plane and said footrest being disposed substantially to the opposite side of said vertical plane, the chair further comprising:

a first assembly in the form of a deformable quadrilateral for supporting the seat, made up of top and bottom bars hinged at a point near said vertical plane and linked at a second point on said first side of said vertical plane by spacer pieces;

a second assembly in the form of a deformable quadrilateral for supporting the footrest and linking the chassis to the first assembly;

a back frame hinged to the first assembly and, a drive assembly interposed between the deformable first assembly and the chassis and performing a pivot-controlling function so as to cause the hinged structure to shift between a low position and an elevated position in which the seat, the footrest, and the back are substantially in generally vertical alignment and, wherein the second assembly is disposed at least in part to said first side of said vertical plane and is linked to the first assembly by at least one reversible actuation and coupling rod, said actuation and coupling rod set back from said vertical plane and disposed beneath a plane defined by the seat in said low position.

2. An elevator chair according to claim 1, wherein the second assembly is hinged to the chassis and to a front piece carried by said second assembly and on which the footrest is fixed.

3. An elevator chair according to claim 2, wherein the front piece is constituted by a rectangular frame.

4. An elevator chair according to claim 1, wherein the second assembly is constituted by two lateral deformable quadrilaterals linked by two rods to two deformable quadrilaterals constituting the first assembly, and with which they form two lateral symmetrical hinged systems.

5. An elevator chair according to claim 1, wherein the second assembly comprises at least one deformable quadrilateral made up of two bars hinged to the chassis and to the first assembly, one of the two bars being linked to the actuating and coupling rod.

6. An elevator chair according to claim 5, wherein the bar linked to the rod is in the form of a crank lever possessing, beyond the hinge axis of said bar on the chassis, a limb extending away from the front plane and linked to the rod.

7. An elevator chair for the handicapped and invalids comprising a chassis supporting a hinged structure including a seat, a footrest, and a back, said seat being disposed substantially to a first side of a vertical plane and said footrest being disposed substantially to the opposite side of said vertical plane, the chair further comprising:

a first assembly in the form of a deformable quadrilateral for supporting the seat, made up of top and bottom bars hinged at a point near said vertical plane and linked at a second point on said first side of said vertical plane by spacer pieces;

a second assembly in the form of a deformable quadrilateral for supporting the footrest and linking the chassis to the first assembly;

a back frame hinged to the first assembly; and, a drive assembly interposed between the deformable first assembly and the chassis and performing a pivot-controlling function so as to cause the hinged structure to shift between a low position and an elevated position in which the seat, the footrest, and the back are substantially in generally vertical alignment, wherein the second assembly is disposed at least in part to said first side of said vertical plane and is linked to the first assembly by at least one reversible actuation and coupling rod, said actuation and coupling rod set back from said vertical plane and disposed beneath a plane defined by the seat in said low position and wherein the hinge link established between the actuation and coupling rod and the deformable quadrilateral of the second assembly comprises a pin carried by one of said actuation and coupling rod and said second assembly and received in an oblong slot of the other one of said actuation and coupling rod and said second assembly.

* * * * *